US009103519B2

(12) United States Patent
Konishi

(10) Patent No.: US 9,103,519 B2
(45) Date of Patent: Aug. 11, 2015

(54) VEHICLE LIGHTING UNIT

(71) Applicant: Stanley Electric Co., Ltd., Tokyo (JP)

(72) Inventor: Sadayuki Konishi, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 74 days.

(21) Appl. No.: 13/949,214

(22) Filed: Jul. 23, 2013

(65) Prior Publication Data

US 2014/0022804 A1 Jan. 23, 2014

(30) Foreign Application Priority Data

Jul. 23, 2012 (JP) ..... 2012-162638

(51) Int. Cl.
*F21S 8/10* (2006.01)

(52) U.S. Cl.
CPC ..... *F21S 48/13* (2013.01); *F21S 48/1145* (2013.01); *F21S 48/1154* (2013.01); *F21S 48/1163* (2013.01); *F21S 48/1225* (2013.01); *F21S 48/1329* (2013.01); *F21S 48/1388* (2013.01); *F21S 48/1394* (2013.01); *F21S 48/145* (2013.01)

(58) Field of Classification Search
CPC ..... F21S 48/13; F21S 8/10; F21S 48/1145; F21S 48/1154; F21S 48/1163; F21S 48/1329; F21S 48/1394; F21S 48/145; F21S 48/1388; F21S 48/1225; F21V 7/09; F21V 7/0083; F21V 7/0025; F21V 7/00
USPC ..... 362/487, 516–518, 520–522, 545, 362/249.02, 245, 241, 247, 308, 311.02, 362/327, 328, 341
See application file for complete search history.

(56) References Cited

U.S. PATENT DOCUMENTS

| | | | | |
|---|---|---|---|---|
| 7,460,985 | B2 | 12/2008 | Benitez et al. | |
| 8,089,374 | B2 * | 1/2012 | Mayer et al. | 362/299 |
| 8,210,727 | B2 * | 7/2012 | Suzuki | 362/539 |

* cited by examiner

*Primary Examiner* — Bao Q Truong
(74) *Attorney, Agent, or Firm* — Kenealy Vaidya LLP

(57) ABSTRACT

A vehicle lighting unit is capable of enhancing the light utilization efficiency by effectively utilizing the part of light emitted from the semiconductor light emitting element that typically does not enter the light guide lens while being reflected by the light incident surface of the lens. The vehicle lighting unit can include a light guide lens a first surface configured to be disposed on a front side of a vehicle body, a second surface configured to be disposed on a rear side thereof and a recessed portion including a third surface; and a light emitting element disposed substantially at a reference point of the light guide lens. The second surface can include a reflection area extending from the recessed portion. The third surface can surround the semiconductor light emitting element, so that the light emitted from the semiconductor light emitting element can be incident on the third surface.

18 Claims, 9 Drawing Sheets

VEHICLE LIGHTING UNIT

This application claims the priority benefit under 35 U.S.C. §119 of Japanese Patent Application No. 2012-162638 filed on Jul. 23, 2012, which is hereby incorporated in its entirety by reference.

TECHNICAL FIELD

The presently disclosed subject matter relates to a vehicle lighting unit, and in particular, to a vehicle lighting unit suitably used as an automotive headlamp, with a structure having a semiconductor light emitting element and a light guide lens in combination.

BACKGROUND ART

Conventionally, various automotive headlamps with a structure having a semiconductor light emitting element and a light guide lens in combination have been proposed, for example, such as those disclosed in U.S. Pat. No. 7,460,985 (Benitez et al.).

FIG. 1 shows a perspective view of an automotive headlamp 200 which is disclosed in U.S. Pat. No. 7,460,985.

As shown, the automotive headlamp 200 can include a light guide lens 210 and a semiconductor light emitting element 220. It is conceivable that the light guide lens 210 could be used as an embodiment of the guide lens in the presently disclosed subject matter. The light guide lens 210 can include a front surface 212 to be disposed on the front side of a vehicle body, a rear surface 214 to be disposed on the rear side of the vehicle body, and a concave portion 216 including a light incident surface 218. The semiconductor light emitting element 220 can be disposed within the concave portion 216. The light incident surface 218 can be configured to surround the semiconductor light emitting element 220 so as to allow the light emitted from the semiconductor light emitting element 220 to be incident thereon efficiently.

The front surface 212 can reflect, toward the rear surface 214, the light emitted from the semiconductor light emitting element 220 and entering the light guide lens 210 through the light incident surface 218 while the front surface 212 can receive the light reflected by the rear surface 214 to allow the light to pass therethrough. The rear surface 214 can reflect the light reflected by the front surface 212 toward the front surface 212.

Specifically, the light emitted from the semiconductor light emitting element 220 can enter the light guide lens 210 through the light incident surface 218, be reflected by the front surface 212 and the rear surface 214, and then be projected through the front surface 212 forward. Therefore, the front surface 212, the rear surface 214 and/or the light incident surface 218 can be designed in surface shape so as to cause the light entering the light guide lens 210 through the light incident surface 218 and reflected by the front surface 212 and the rear surface 214 and then projected forward through the front surface 214 to form a predetermined light distribution pattern.

However, in the automotive headlamp 200 disclosed in U.S. Pat. No. 7,460,985, part of light emitted from the semiconductor light emitting element 220 does not enter the light guide lens 210 while being reflected by the light incident surface 218, and is therefore wasted without being utilized for the formation of the predetermined light distribution pattern. This can reduce the light utilization efficiency.

SUMMARY

The presently disclosed subject matter was devised in view of these and other problems and features in association with the conventional art. According to an aspect of the presently disclosed subject matter, there is provided a vehicle lighting unit capable of enhancing the light utilization efficiency by effectively utilizing the part of light emitted from the semiconductor light emitting element that cannot enter the light guide lens while being reflected by the light incident surface of the lens.

According to another aspect of the presently disclosed subject matter, a vehicle lighting unit can include a lens having a focal point, a first surface to be disposed on a front side of a vehicle body and a second surface to be disposed on a rear side of the vehicle body, and a semiconductor light emitting element disposed on or near the focal point of the lens. The second surface can be configured to allow light emitted from the semiconductor light emitting element to enter the lens. The first surface can be configured to allow the light entering the lens through the second surface to exit the lens. The first surface and/or the second surface can be designed in surface shape so that the light exiting forward through the first surface can form a low beam light distribution pattern. The vehicle lighting unit can further include a reflection surface for forming an over-head sign light distribution pattern, disposed below the semiconductor light emitting element.

With the vehicle lighting unit having the above configuration, the light emitted from the semiconductor light emitting element that is reflected by the light incident surface and which does not enter the light guide lens can be reflected by the reflection surface for forming an over-head sign light distribution pattern. The reflected light can then enter the light guide lens through the light incident surface, and exit through the front surface to be projected forward. Since the reflection surface for forming an over-head sign light distribution pattern can be disposed below the semiconductor light emitting element, the light reflected by the reflection surface and then projected through the front surface can be directed upward by a predetermined angle with respect to a horizontal plane. Accordingly, an over-head sign light distribution pattern can be formed by that light.

As described, by effectively utilizing the part of light emitted from the semiconductor light emitting element that typically does not enter the light guide lens while being reflected by the light incident surface of the lens to form an over-head sign light distribution pattern, a vehicle lighting unit that can serve as an automotive headlamp can be provided with higher light utilization efficiency.

According to still another aspect of the presently disclosed subject matter, a vehicle lighting unit can include a light guide lens having a reference point, a first surface to be disposed on a front side of a vehicle body, a second surface to be disposed on a rear side of the vehicle body and a recessed portion including a third surface, and a semiconductor light emitting element disposed within the recessed portion and substantially at (i.e., at, on or near) the reference point of the light guide lens. The second surface can be configured to include a reflection area extending from the recessed portion in a predetermined direction. The third surface can be disposed to surround the semiconductor light emitting element, so that the light emitted from the semiconductor light emitting element can be incident on the third surface. The first surface can be configured to reflect the light entering the light guide lens through the third surface toward the reflection area of the second surface while being configured to allow the light reflected by the reflection area of the second surface to exit the lens therethrough. The first surface, the second surface and/or the third surface can be designed in surface shape so that the light exiting forward through the first surface can form a low beam light distribution pattern. The vehicle lighting unit can further include a reflection surface for forming an over-head sign light distribution pattern, disposed below the semiconductor light emitting element.

With the vehicle lighting unit having the above configuration, the light emitted from the semiconductor light emitting element that is reflected by the light incident surface and which does not enter the light guide lens can be reflected by the reflection surface for forming an over-head sign light distribution pattern. The reflected light can then enter the light guide lens through the light incident surface, be reflected by the front surface and the rear surface, and exit through the front surface to be projected forward. Since the reflection surface for forming an over-head sign light distribution pattern can be disposed below the semiconductor light emitting element, the light reflected by the reflection surface and projected through the front surface can be directed upward by a predetermined angle with respect to a horizontal plane. Accordingly, an over-head sign light distribution pattern can be formed by that light.

As described, by effectively utilizing the part of light emitted from the semiconductor light emitting element that does not enter the light guide lens while being reflected by the light incident surface of the lens to form an over-head sign light distribution pattern, a vehicle lighting unit that can serve as an automotive headlamp can be provided with higher light utilization efficiency.

In the vehicle lighting unit with any of the above configurations, the reflection surface for forming an over-head sign light distribution pattern can be formed from a mirror or a high reflectance member.

The vehicle lighting unit with any of the above configurations can further include a high reflectance member disposed to surround the semiconductor light emitting element so as to extract the light emitted from the semiconductor light emitting element by reflection, and a shading member disposed to cover the high reflectance member while exposing part of the high reflectance member that can function as the reflection surface for forming an over-head sign light distribution pattern.

In the vehicle lighting unit with the above configuration, part of the high reflectance member disposed to surround the semiconductor light emitting element can be utilized as the reflection surface for forming an over-head sign light distribution pattern. This means that there is no need to form a dedicated reflection surface for forming an over-head sign light distribution pattern, resulting in reduction of production costs.

The vehicle lighting unit with the above configurations can be configured such that the high reflectance member is formed from a white resin.

In the vehicle lighting unit with the above configuration, part of the high reflectance member formed from a white resin and disposed to surround the semiconductor light emitting element can be utilized as a reflection surface for forming an over-head sign light distribution pattern. This also means that there is no need to form a dedicated reflection surface forming an over-head sign light distribution pattern, resulting in reduction of production costs.

It should also be noted that the first surface can reflect the light entering the light guide lens through the third surface toward the reflection area of the second surface while allowing the light reflected by the reflection area of the second surface to exit the lens therethrough. The first surface, the second surface and/or the third surface can be designed so that the light exiting forward through the first surface can form a low beam light distribution pattern. The vehicle lighting unit can further include a reflection surface for forming an over-head sign light distribution pattern, disposed below the semiconductor light emitting element.

According to the presently disclosed subject matter, there can be provided a vehicle lighting unit capable of enhancing the light utilization efficiency by effectively utilizing part of light emitted from the semiconductor light emitting element that does not enter the light guide lens while being reflected by the light incident surface of the lens.

BRIEF DESCRIPTION OF DRAWINGS

These and other characteristics, features, and advantages of the presently disclosed subject matter will become clear from the following description with reference to the accompanying drawings, wherein.

DESCRIPTION OF EXEMPLARY EMBODIMENTS

A description will now be made below to vehicle lighting units of the presently disclosed subject matter with reference to the accompanying drawings in accordance with exemplary embodiments.

Note that in the present description, the directions of "front (forward)," "back (rear, rearward)," "left," "right," "up (high, above)," and "down (low, below)" mean the corresponding directions when viewed with respect to a vehicle lighting unit installed in a vehicle body of an automobile to project light forward of the vehicle body.

Figure 1:
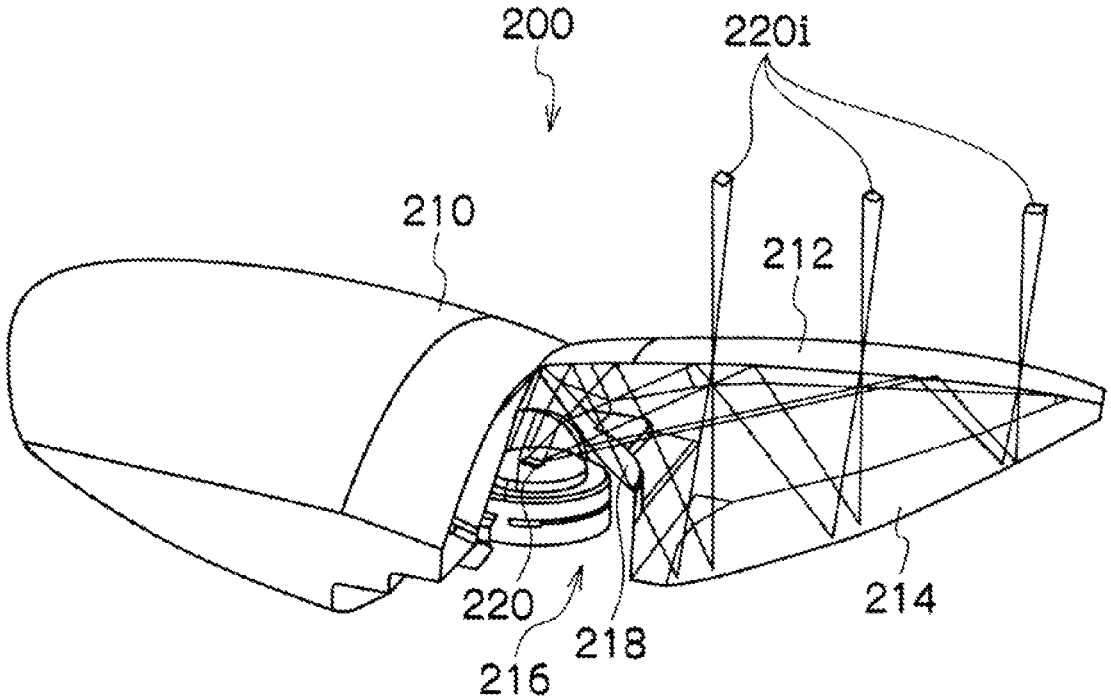
Fig. 1 Conventional Art
FIG. 1 is a perspective view illustrating an conventional automotive headlamp.
Figure 2:
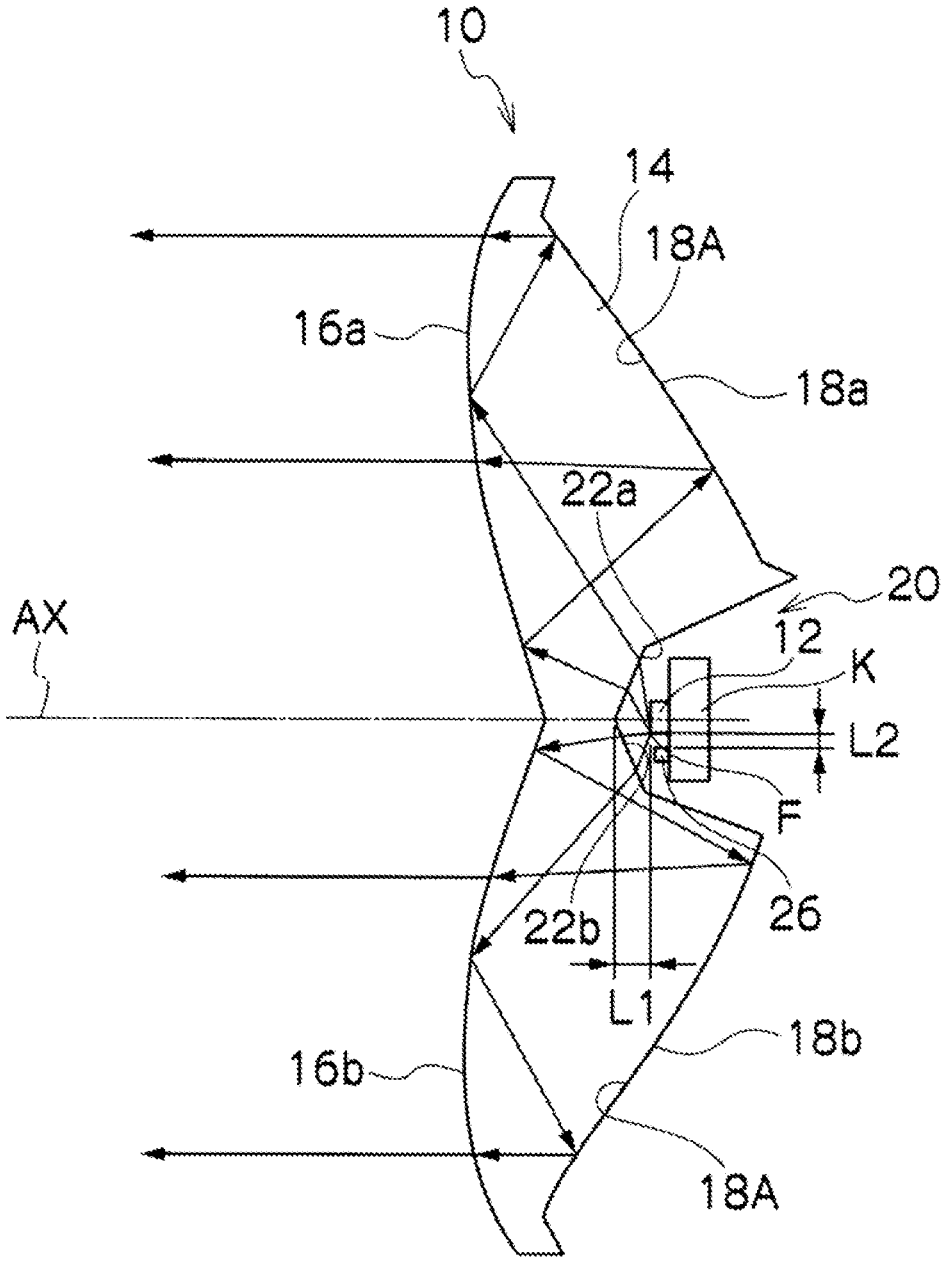
FIG. 2 is a cross-sectional view illustrating a vehicle lighting unit made in accordance with principles of the presently disclosed subject matter, vertically cut along a plane including its center axis, also showing light paths for light emitted from a semiconductor light emitting element and entering a light guide lens through its light incident surface.

FIG. 2 is a cross-sectional view illustrating a vehicle lighting unit made in accordance with principles of the presently disclosed subject matter, vertically cut along a plane including its center axis. The drawing also shows light paths for light emitted from a semiconductor light emitting element and entering a light guide lens through its light incident surface.

At least one vehicle lighting unit 10 of the present exemplary embodiment can be provided at either side of a front face of a vehicle body, such as an automobile. The vehicle lighting unit 10 can include a known aiming mechanism (not shown) for adjusting its optical axis.

As shown in FIG. 2, the vehicle lighting unit 10 of the present exemplary embodiment can include a semiconductor light emitting element 12, a light guide lens 14, a reflection surface 26 for forming an over-head sign light distribution pattern, and the like.

The semiconductor light emitting element 12 can be composed of a plurality of semiconductor light emitting elements 12*a* to 12*e* (such as LEDs). The LED can be a white light source for emitting white light satisfying the whiteness specification defined by a white range on the CIE chromaticity diagram as stipulated by certain laws or regulations. The white light source can be configured by combining a blue LED chip (or laser diode) with a yellow wavelength conversion material such as YAG phosphor covering the chip. The semiconductor light emitting element 12 is not particularly limited as long as it can emit white light satisfying the whiteness specification defined by a white range on the CIE chromaticity diagram. Accordingly, other examples thereof may include those having a structure of a combination of RGB LED chips (or laser diodes), in addition to the above white LED including a blue LED chip.

Figure 3:
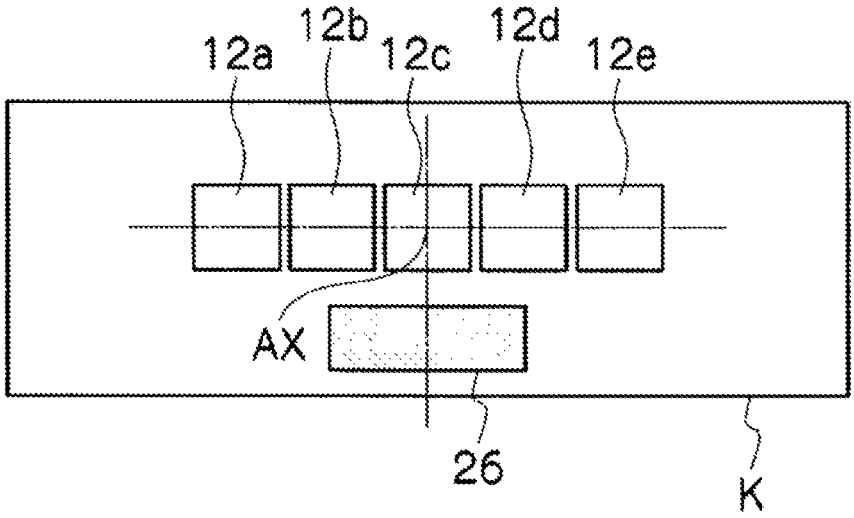
FIG. 3 is a front view of the semiconductor light emitting element and a reflection surface for forming an over-head sign light distribution pattern in the vehicle lighting unit shown in FIG. 2.

FIG. 3 is a front view of the semiconductor light emitting element and a reflection surface for forming an over-head sign light distribution pattern in the vehicle lighting unit shown in FIG. 2.

As shown in FIG. 3, the semiconductor light emitting elements 12 (12*a* to 12*e*) can include square light emission surfaces as an outer shape (for example, each side being 1 mm). The semiconductor light emitting elements 12 (12*a* to 12*e*) can be mounted on a substrate K, for example, in line at predetermined intervals in a horizontal direction (vehicle width direction) perpendicular to a center axis AX (being a reference axis or an optical axis) extending in the front-rear direction while the emission surfaces of the elements are directed to the front side. As a result, a long rectangular emission surface (composed of five emission surfaces with each side being 1 mm) in the vehicle width direction can be formed as a whole. Herein, the center axis AX passes approximately center of the semiconductor light emitting elements 12 (12*a* to 12*e*) arranged in line as a whole in the vehicle width direction. Further, the lower sides (lower edges) of the semiconductor light emitting elements 12 (12*a* to 12*e*) can be aligned with a reference point F of the light guide lens 14 in terms of the optical design. (See FIG. 2.) Herein, the reference point F can correspond to the optical center or a focal point of the light guide lens 14. Accordingly, the light guide lens 14 can include front surfaces 16 (16*a*, 16*b*), rear surfaces 18 (18*a*, 18*b*) and light incident surfaces 22 (22*a*, 22*b*) that have been designed in terms of their shape on the basis of the reference point F. The number of the semiconductor light emitting elements is not limited to 5, but can be one to four or six or more.

Figure 4A:
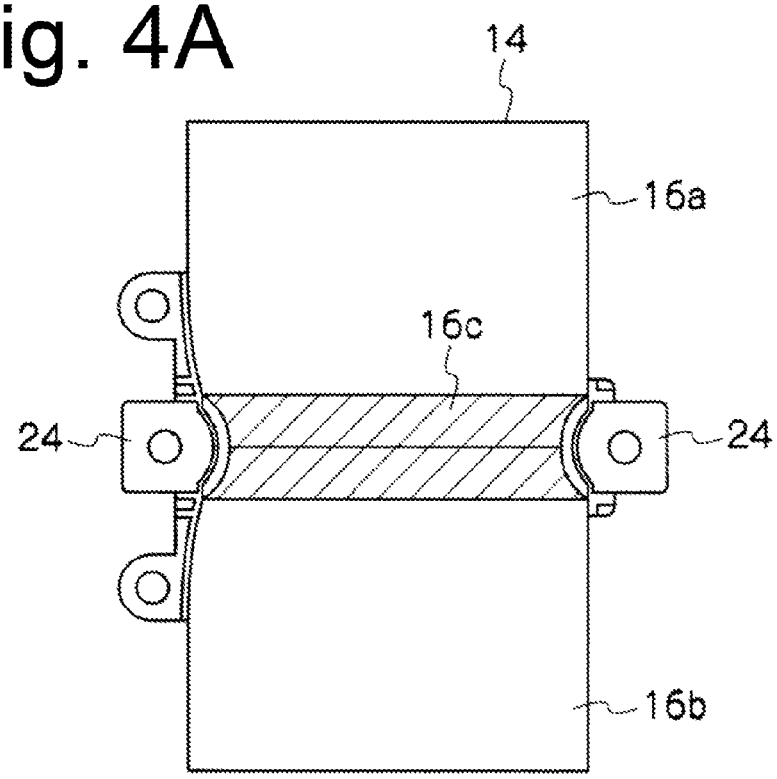
FIGS. 4A and 4B are a front view and a rear view of the light guide lens shown in FIG. 2, respectively.
Figure 4B:
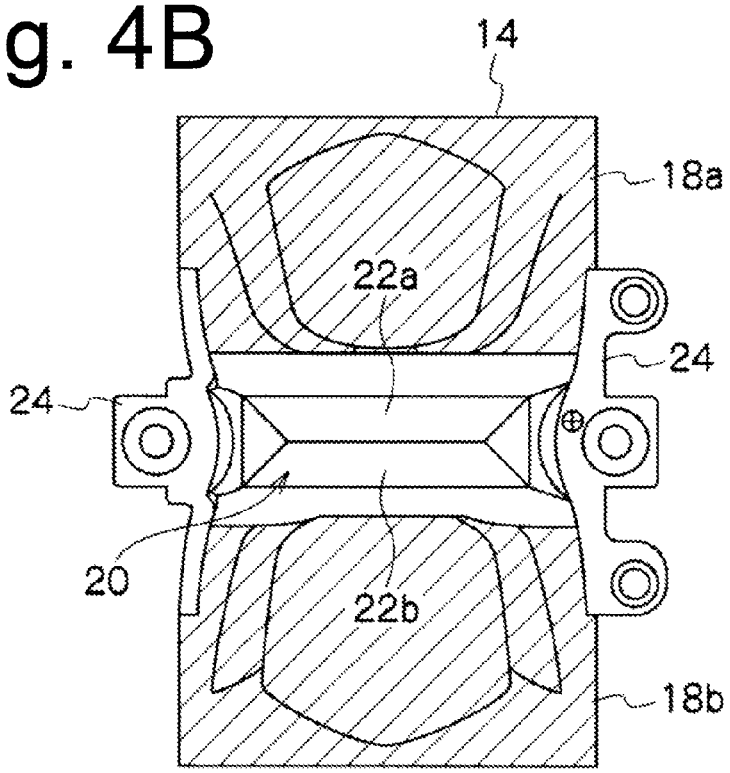

FIGS. 4A and 4B are a front view and a rear view of the light guide lens shown in FIG. 2, respectively.

As shown in FIGS. 2, 4A, and 4B, the light guide lens 14 can include, on its surfaces, the front surfaces 16 (16*a*, 16*b*) disposed on the front side with respect to the vehicle body, the rear surfaces 18 (18*a*, 18*b*) disposed on the rear side with respect to the vehicle body, and a recessed portion 20 including light incident surfaces 22 (22*a*, 22*b*). The above-mentioned reference point F of the light guide lens 14 can be positioned within the recessed portion 20. The semiconductor light emitting elements 12 (12*a* to 12*e*) can be disposed substantially at (i.e., at or near) the reference point F within the recessed portion 20, as shown in FIG. 2 by securing the substrate K, on which the semiconductor light emitting elements 12*a* to 12*e* have been mounted, with respect to the light guide lens 14, for example. A distance L1 between the semiconductor light emitting elements 12 (12*a* to 12*e*) and the light incident surfaces 22 along the center axis AX can be set, for example, to 2.7 mm.

The light guide lens 14 can be molded by injecting a molten glass or a transparent resin such as acrylic resin, polycarbonate resin, or the like in a cavity of a mold, and cooling it for solidification.

The light guide lens 14 can be configured such that the light emitted from the semiconductor light emitting elements 12 (12*a* to 12*e*) can enter the light guide lens 14, be reflected by the front surfaces 16 (16*a*, 16*b*) (internal reflection) and then be reflected by the rear surfaces 18 (18*a*, 18*b*) (internal reflection), so that the reflected light can exit the light guide lens 14 through the front surfaces 16 (16*a*, 16*b*) forward.

The recessed portion 20 of the light guide lens 14 can include the light incident surfaces 22 (22*a*, 22*b*). The light incident surfaces 22 (22*a*, 22*b*) can be configured to allow the light emitted from the semiconductor light emitting elements 12 (12*a* to 12*e*) to enter the light guide lens 14. Therefore, the surface shapes of the light incident surfaces 22 (22*a*, 22*b*) surrounding the semiconductor light emitting elements 12 (12*a* to 12*e*) should be designed so as to efficiently receive the light emitted from the semiconductor light emitting elements 12 (12*a* to 12*e*).

As shown in FIGS. 2 and 4B, the recessed portion 20 can be formed in a partial columnar recessed portion extending in the horizontal direction (in the right-left direction in FIG. 4B) to show an isosceles triangle as a vertical cross-section (FIG. 2). Namely, the bottom surfaces of the columnar recessed portion 20 can function as the light incident surfaces 22 (22*a*, 22*b*).

Further, the light incident surfaces 22 (22*a*, 22*b*) are not limited to the bottom surfaces of the columnar recessed portion, but can be any surfaces as long as the surfaces can properly receive the light emitted from the semiconductor light emitting elements 12 (12*a* to 12*e*) to allow the light to enter the light guide lens 14. Examples of the shape thereof may include a semi-spherical recessed portion to utilize the semi-spherical bottom surface as the light incident surface 22.

As shown in FIG. 2, the front surfaces 16 (16*a*, 16*b*) can include an upper area 16*a* and a lower area 16*b*. The rear surfaces 18 (18*a*, 18*b*) can correspondingly include an upper area 18*a* and a lower area 18*b* as well as a reflection area 18A which is an inner side of the rear surfaces 18. The upper and lower areas 16*a* and 16*b* of the front surfaces 16 can reflect the light emitted from the semiconductor light emitting elements 12 (12*a* to 12*e*) and which is incident on the light incident surface 22 (22*a*, 22*b*) to enter the light guide lens 14, so as to be directed to the reflection area 18A of the rear surfaces 18 (18*a*, 18*b*). The upper and lower areas 16*a* and 16*b* of the front surfaces 16 can also function as an exiting surface where the light reflected from the reflection area 18A of the rear surfaces 18 (18*a*, 18*b*) can be refracted and exit therethrough.

The upper area 16*a* of the front surfaces 16 can be a forwardly convex surface and disposed above the center axis AX while the lower area 16*b* thereof can be a forwardly convex surface and disposed below the center axis AX.

As shown in FIG. 4A, the front surfaces 16 (16*a*, 16*b*) can be a rectangular outer shape when viewed from its front side. Note that the outer shape of the front surfaces 16 (16*a*, 16*b*) is not limited to a rectangular shape, but may be any appropriate shape according to the body design of the vehicle body. Examples of the front surfaces 16 (16*a*, 16*b*) may include a circle, an oval, a polygon, and the like when viewed from its front side.

The front surfaces 16 (16*a*, 16*b*) can include an area where an incident angle of light emitted from the semiconductor light emitting elements 12 (12*a* to 12*e*) is less than a critical angle and another area where the incident angle thereof exceeds the critical angle.

The area where the incident angle is less than the critical angle can be subjected to aluminum deposition or the like mirror finishing so as to form a horizontally long strip-shaped reflection area 16*c* as shown in FIG. 4A, where the area 16*c* is hatched.

On the contrary, the area where the incident angle exceeds the critical angle is not subjected to aluminum deposition or the like mirror finishing (area other than the strip-shaped reflection area 16*c* in FIG. 4A).

Accordingly, part of the light emitted from the semiconductor light emitting elements 12 (12*a* to 12*e*) can be incident on the strip-shaped reflection area 16*c* of the front surfaces 16 (16*a*, 16*b*) to be reflected (internal reflection) by the same rearward (toward the rear surfaces 18 (18*a*, 18*b*)).

On the other hand, a remaining part of the light emitted from the semiconductor light emitting elements 12 (12*a* to 12*e*) can be incident on the area other than the strip-shaped reflection area 16*c* and can be totally reflected (total reflection) by the same rearward (toward the rear surfaces 18 (18*a*, 18*b*)).

As shown in FIG. 2, the rear surfaces 18 (18*a*, 18*b*) can include the upper area 18*a* extending from the recessed portion 20 upward and the lower area 18*b* extending from the recessed portion 20 downward. The rear surfaces 18 (18*a*, 18*b*) can reflect light emitted from the semiconductor light emitting elements 12 (12*a* to 12*e*) after having been reflected by the front surfaces 16 (16*a*, 16*b*) toward the front surfaces 16 to locations other than the strip-shaped reflection area 16*c*.

The upper area 18*a* can be a rearwardly convex surface extending upward from the rear end of the recessed portion 20, to be disposed above the center axis AX. The lower area 18*b* can be a rearwardly convex surface extending downward from the rear end of the recessed portion 20, to be disposed below the center axis AX.

The rear surfaces 18 (18*a*, 18*b*) can be subjected to aluminum deposition or the like mirror finishing, thereby forming the reflection area 18A extending from the recessed portion 20 upward and downward. In FIG. 4B, the mirror finished area or the reflection area 18A is hatched to show the area 18A in the rear surfaces 18 (18*a*, 18*b*).

Figure 5:
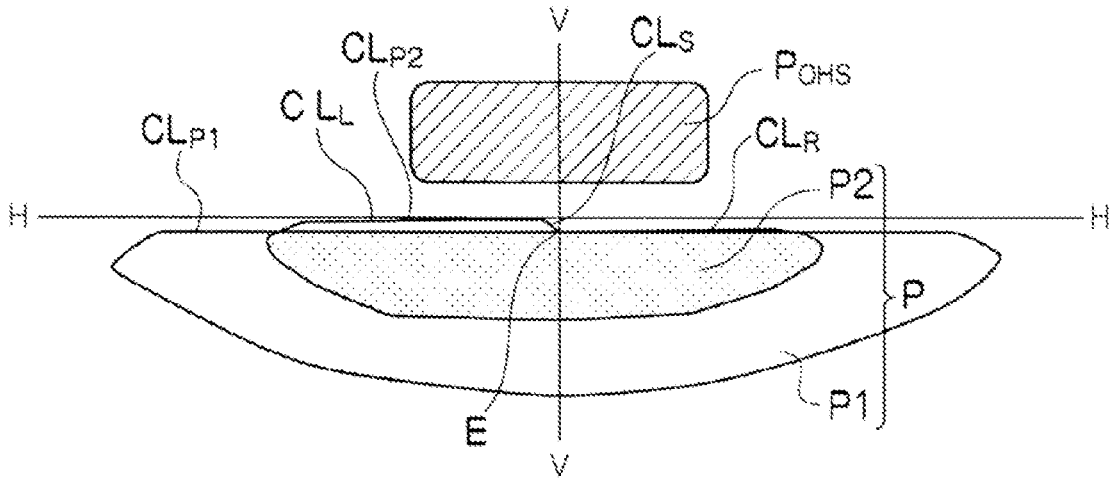
FIG. 5 illustrates a light distribution pattern formed by the vehicle lighting unit of FIG. 2, including a low beam light distribution pattern P and an over-head sign light distribution pattern $P_{OHS}$.

The front surfaces 16 (16*a*, 16*b*), the rear surfaces 18 (18*a*, 18*b*) and/or the light incident surfaces 22 (22*a*, 22*b*) can be designed in terms of their surface shapes so as to be capable of forming a low beam light distribution pattern P as shown in FIG. 5. Specifically, the thus designed light incident surfaces 22 (22*a*, 22*b*) can properly receive the light to allow the light to enter the light guide lens 14, and the thus designed front surfaces 16 (16*a*, 16*b*) and rear surfaces 18 (18*a*, 18*b*) can properly reflect the light so that the light (or the light source image of the semiconductor light emitting elements 12) can properly exit through the front surfaces 16 (16*a*, 16*b*) to form the intended low beam light distribution pattern P. As an example, the low beam light distribution pattern P can be formed by the thus designed front surfaces 16 (16*a*, 16*b*), rear surfaces 18 (18*a*, 18*b*) and/or light incident surfaces 22 (22*a*, 22*b*) so that the light source image of the semiconductor light emitting elements 12 can be disposed below the horizontal line (H line) by 0.57 degrees or less.

More specifically, the light emitted from the semiconductor light emitting elements 12 (12*a* to 12*e*) (or the light source image of the semiconductor light emitting elements 12) can be incident on the light incident surface 22 (22*a*, 22*b*) to enter the light guide lens 14. Then, the light can be reflected by the front surfaces 16 (16*a*, 16*b*) to be directed to the rear surfaces 18 (18*a*, 18*b*). The reflected light can be further reflected by the reflection area 18A of the rear surfaces 18 to be directed to the front surfaces 16 (16*a*, 16*b*). The forwardly travelling light can exit through the front surface 16, specifically, through the area of the front surface 16 other than the strip-shaped reflection area 16*c*. Then, the light can be projected onto a virtual vertical screen assumed to be formed in front of the vehicle body about 25 m away from the vehicle body, thereby forming the low beam light distribution pattern P including a first light distribution pattern P1 and a second light distribution pattern P2 overlaid with each other as shown in FIG. 5.

Furthermore, FIG. 5 includes the low beam light distribution pattern P and the over-head sign light distribution pattern $P_{OHS}$ formed by the vehicle lighting unit.

As described above, the low beam light distribution pattern P can be formed as a synthesized light distribution pattern including the first light distribution pattern P1 and the second light distribution pattern P2 overlaid with each other.

As shown in FIG. 5, the first light distribution pattern P1 can be formed as a horizontally wide light distribution pattern including a horizontally extending cut-off line $CL_{P1}$. The second light distribution pattern P2 can be formed as a horizontally focused light distribution pattern narrower than the first light distribution pattern P1. The second light distribution pattern P2 can be formed to include a cut-off line $CL_{P2}$. The cut-off line $CL_{P2}$ can include a horizontally extending left cut-off line $CL_L$, a slant cut-off line $CL_S$ extending from the right end of the left cut-off line $CL_L$ rightward, and a horizontally extending right cut-off line $CL_R$ extending from the lower end of the slant cut-off line $CL_S$. The second light distribution pattern P2 can be disposed such that the intersection E between the slant cut-off line $CL_S$ and the right cut-off line $CL_R$, or upper end elbow point as a horizontal reference point, is located on a vertical line V-V.

As shown in FIGS. 4A and 4B, the light guide lens 14 can be fixed to a housing or the like at both sides by means of supporting sections 24, so that the front surfaces 16 (16*a*, 16*b*) can be directed forward while the rear surfaces 18 (18*a*, 18*b*) can be directed rearward.

The reflection surface 26 for forming an over-head sign light distribution pattern can be used to form the over-head sign light distribution pattern $P_{OHS}$ for illuminating a road guide plate, a road sign, and the like disposed above a road with light. (See FIG. 5.)

Figure 6:
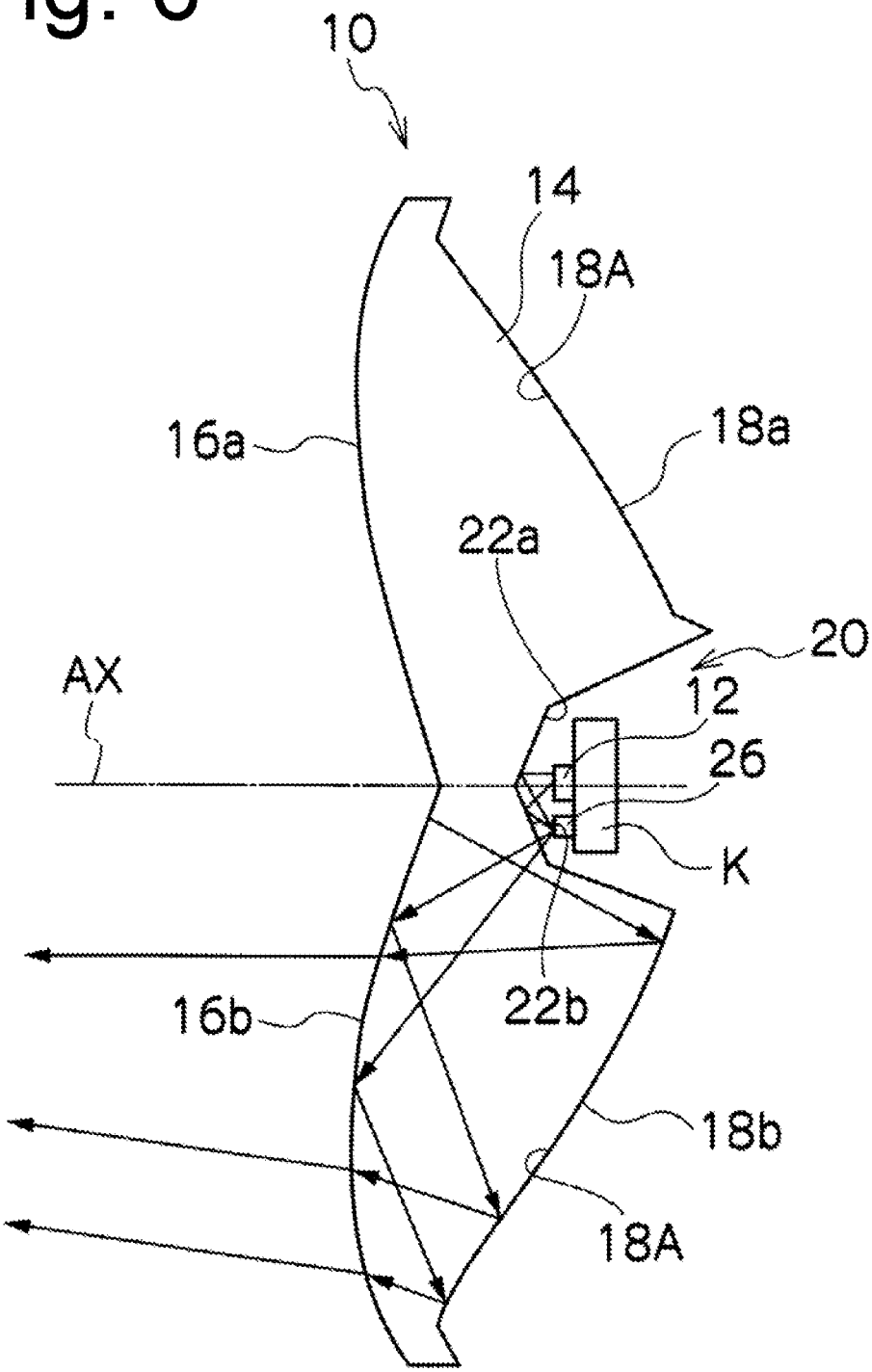
FIG. 6 is a cross-sectional view illustrating light paths of light emitted from the semiconductor light emitting element that is reflected by the light incident surface, is reflected by the reflection surface for an over-head sign light distribution pattern, and enters the light guide lens through the light incident surface according to the presently disclosed subject matter.

FIG. 6 is a cross-sectional view illustrating light paths of light emitted from the semiconductor light emitting elements 12 that is reflected by the light incident surface 22, is reflected by the reflection surface 26 for an over-head sign light distribution pattern, and enters the light guide lens 14 through the light incident surface 22.

As shown in FIG. 6, the reflection surface 26 for forming an over-head sign light distribution pattern can reflect light that is emitted from the semiconductor light emitting elements 12 (12*a* to 12*e*) and does not enter the light guide lens 14 while being reflected by the light incident surface 22 to the lower side of the semiconductor light emitting elements 12 (12*a* to 12*e*). Accordingly, the reflection surface 26 for forming an over-head sign light distribution pattern can be disposed below the semiconductor light emitting elements 12 (12*a* to 12*e*) within the recessed portion 20.

Herein, the reflection surface 26 for forming an over-head sign light distribution pattern can be made of a horizontally long rectangular mirror when viewed from its front side, as shown in FIG. 3. The mirror may be planar or curved, as desired. The reflection surface 26 can be fixed to the substrate K, on which the semiconductor light emitting elements 12 (12*a* to 12*e*) are mounted, below the semiconductor light emitting elements 12 (12*a* to 12*e*) with a known means such as an adhesive, thereby being located below the semiconductor light emitting elements 12 (12*a* to 12*e*) within the recessed portion 20. The reflection surface 26 and the semiconductor light emitting elements 12 (12*a* to 12*e*) may be separately prepared for installation on the substrate K or may be packaged in combination to be mounted as one component on the substrate K.

In a normal case, the light emitted from the semiconductor light emitting elements 12 (12*a* to 12*e*) can enter the light guide lens 14 through the light incident surfaces 22 (22*a*, 22*b*) and be reflected by the front surfaces 16 (16*a*, 16*b*) and the rear surfaces 18 (18*a*, 18*b*). Then, the reflected light can be refracted by the front surfaces 16 (other than the strip-shaped reflection area 16*c*) to be projected forward, thereby forming the low beam light distribution pattern P as shown in FIG. 5.

However, in some cases, part of light emitted from the semiconductor light emitting elements 12 (12*a* to 12*e*) does not enter the light guide lens 14 as shown in FIG. 6, but may be reflected downward by the light incident surfaces 22 (22*a*, 22*b*) to the position below the semiconductor light emitting elements 12 (12*a* to 12*e*).

The light reflected by the light incident surfaces 22 (22*a*, 22*b*) can be reflected by the reflection surface 26 for forming an over-head sign light distribution pattern. Then, the reflected light can enter the light guide lens 14 through the light incident surface 22, be reflected by the front surface 16 and the rear surface 18, and be refracted by the front surface 16 (other than the strip-shaped reflection area 16*c*), thereby being projected forward.

Since the reflection surface 26 for forming an over-head sign light distribution pattern is located below the semiconductor light emitting elements 12 (12*a* to 12*e*), the light projected from the front surface 16 can be directed upward by a certain angle with respect to the horizontal plane. This can form the over-head sign light distribution pattern $P_{OHS}$.

The reflection surface 26 for forming an over-head sign light distribution pattern can be adjusted in terms of the horizontal and vertical dimensions. As a result, the horizontal and vertical dimensions of the over-head sign light distribution pattern $P_{OHS}$ can be adjusted. The distance L2 between the semiconductor light emitting elements 12 (12*a* to 12*e*) and the reflection surface 26 for forming an over-head sign light distribution pattern can be adjusted (see FIG. 2), thereby adjusting the vertical position of the formed over-head sign light distribution pattern $P_{OHS}$.

Therefore, the horizontal and vertical dimensions of the reflection surface 26 and the distance L2 between the semiconductor light emitting elements 12 and the reflection surface 26 can adjust the formation of the over-head sign light distribution pattern $P_{OHS}$ such that the formed pattern is located above the horizontal line H-H by 2 to 4 degrees and within an appropriate horizontal angular range with respect to the vertical line V-V.

The vehicle lighting unit 10 can be adjusted by a known aiming mechanism (not shown) for adjusting its optical axis in order to project the respective light distribution patterns P and $P_{OHS}$ over a proper range on the virtual vertical screen.

As described above, the light emitted from the semiconductor light emitting elements 12 (12*a* to 12*e*) that is reflected by the light incident surfaces 22 (22*a*, 22*b*) and which does not enter the light guide lens 14 can be reflected by the reflection surface 26 for forming an over-head sign light distribution pattern. The reflected light can then enter the light guide lens 14 through the light incident surface 22, be reflected by the front surface 16 and the rear surface 18, and exit through the front surface 16 (other than the strip-shaped reflection area 16*c*) to be projected forward. Since the reflection surface 26 for forming an over-head sign light distribution pattern can be disposed below the semiconductor light emitting elements 12 (12*a* to 12*e*), the light projected through the front surface 16 can be directed upward by a predetermined angle with respect to the horizontal plane. Accordingly, the over-head sign light distribution pattern $P_{OHS}$ can be formed by that light.

As described, by effectively utilizing the part of light emitted from the semiconductor light emitting elements 12 (12*a* to 12*e*) that does not enter the light guide lens 14 due to the reflection by the light incident surface 22 to form the over-head sign light distribution pattern $P_{OHS}$, the resulting vehicle lighting unit 10 can be provided with higher light utilization efficiency.

Specifically, the vehicle lighting unit 10 of the present exemplary embodiment can adopt an optical system in which the light can enter the light guide lens 14 through the light incident surfaces 22 (22*a*, 22*b*), be reflected twice by the front surfaces 16 (16*a*, 16*b*) and the rear surfaces 18 (18*a*, 18*b*), and then be projected through the front surfaces 16 (other than the strip-shaped reflection area 16*c*). In other words, the vehicle lighting unit 10 can adopt an optical system in which the light path is folded back within the light guide lens 14. When compared with a vehicle lighting unit 10B without such an optical system, to be described later, the distance L1 between the semiconductor light emitting elements 12 (12*a* to 12*e*) and the light incident surfaces 22 (rear surface 36) along the center axis AX can be shortened (for example by 2.7 mm). This configuration can direct much amount of light to the lower position below the semiconductor light emitting elements 12 (12*a* to 12*e*). As a result, a brighter over-head sign light distribution pattern $P_{OHS}$ can be formed.

Next, a modified example of the vehicle lighting unit 10 will be described. Herein, the modified example is a vehicle lighting unit 10A utilizing a high reflectance member 28 (for example, white resin) as the reflection surface 26 for forming an over-head sign light distribution pattern.

The vehicle lighting unit 10A is different from the vehicle lighting unit 10 of the previous exemplary embodiment in that the high reflectance member 28, such as a white resin, is used as the reflection surface 26 for forming an over-head sign light distribution pattern, and other configuration and members thereof can be the same as or similar to those of the vehicle lighting unit 10 of the previous exemplary embodiment. Hereinafter, the difference will be described, and the same or similar components to those of the vehicle lighting unit 10 of the previous exemplary embodiment will be denoted by the same reference numerals, and the description thereof will be omitted.

Figure 7:
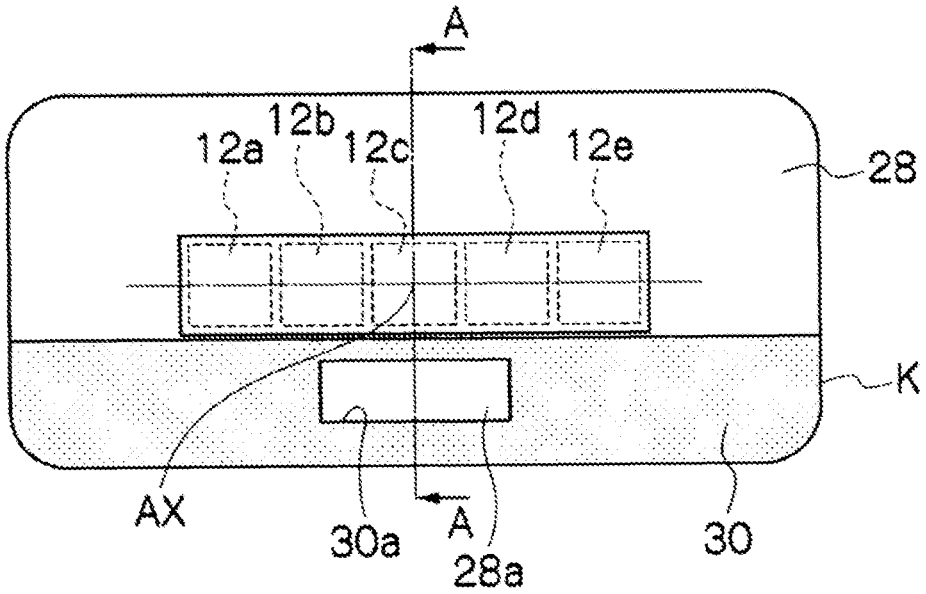
FIG. 7 is a front view of a modified example of a semiconductor light emitting element and reflection surface for forming an over-head sign light distribution pattern in a vehicle lighting unit according to the presently disclosed subject matter.
Figure 8:
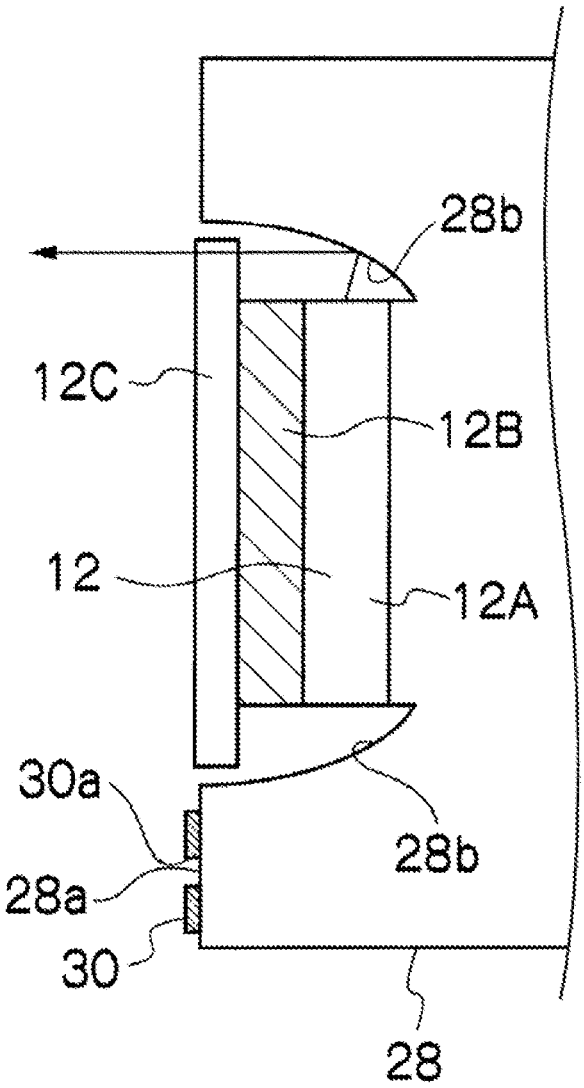
FIG. 8 is a cross-sectional view taken along line A-A in FIG. 7.

FIG. 7 is a front view of the modified example of the vehicle lighting unit 10A including semiconductor light emitting elements and a reflection surface for forming an over-head sign light distribution pattern. FIG. 8 is a cross-sectional view taken along line A-A in FIG. 7.

Conventionally, high reflectance materials such as a white resin have been used for forming a reflection cavity receiving a semiconductor light emitting element, thereby achieving effective use of light emitted sideward from the semiconductor light emitting element. In the present modified example, the high reflectance material used for achieving effective use of light is simultaneously used as the reflection surface for forming an over-head sign light distribution pattern.

Specifically, as can be seen from FIGS. 7 and 8, the high reflectance member 28 made of such a white resin can be configured to surround the semiconductor light emitting elements 12 (12*a* to 12*e*) so that the light emitted sideward from the semiconductor light emitting elements 12 (12*a* to 12*e*) can be reflected by the high reflectance member 28, thereby achieving favorable extraction of light forward.

Accordingly, the high reflectance member 28 can include a reflection surface 28*b* for forwardly reflecting light emitted sideward from the semiconductor light emitting elements 12 (12*a* to 12*e*). Note that in FIG. 8, the LED chips constituting the semiconductor light emitting elements 12 (12*a* to 12*e*) are denoted by 12A, the phosphor constituting the semiconductor light emitting elements 12 (12*a* to 12*e*) is denoted by 12B, and a glass plate is denoted by 12C.

In the present modified example, as shown in FIGS. 7 and 8, the high reflectance member 28 can be present (extend) below one sides (lower edge) of the semiconductor light emitting elements 12 (12*a* to 12*e*). Furthermore, the high reflectance member 18 can be provided with a shading member 30 having an opening 30*a* where part of the high reflectance member 18 can be exposed therethrough. By forming the opening 30*a* at an appropriate position in the shading member 30, the part 28*a* of the high reflectance member 18 can serve as the reflection surface for forming an over-head sign light distribution pattern (previously denoted by 26).

In the present modified example, the part 28*a* of the high reflectance member 28 disposed to surround the semiconductor light emitting elements 12 (12*a* to 12*e*) for extracting light emitted sideward therefrom with high efficiency can be utilized as a reflection surface for forming an over-head sign light distribution pattern. This means that there is no need to form a dedicated reflection surface for forming an over-head sign light distribution pattern, resulting in reduction of production costs.

Next, another modified example of the vehicle lighting unit 10 will be described with reference to FIG. 9. In this modified example, a projector lens is utilized in place of the light guide lens 14.

Figure 9:
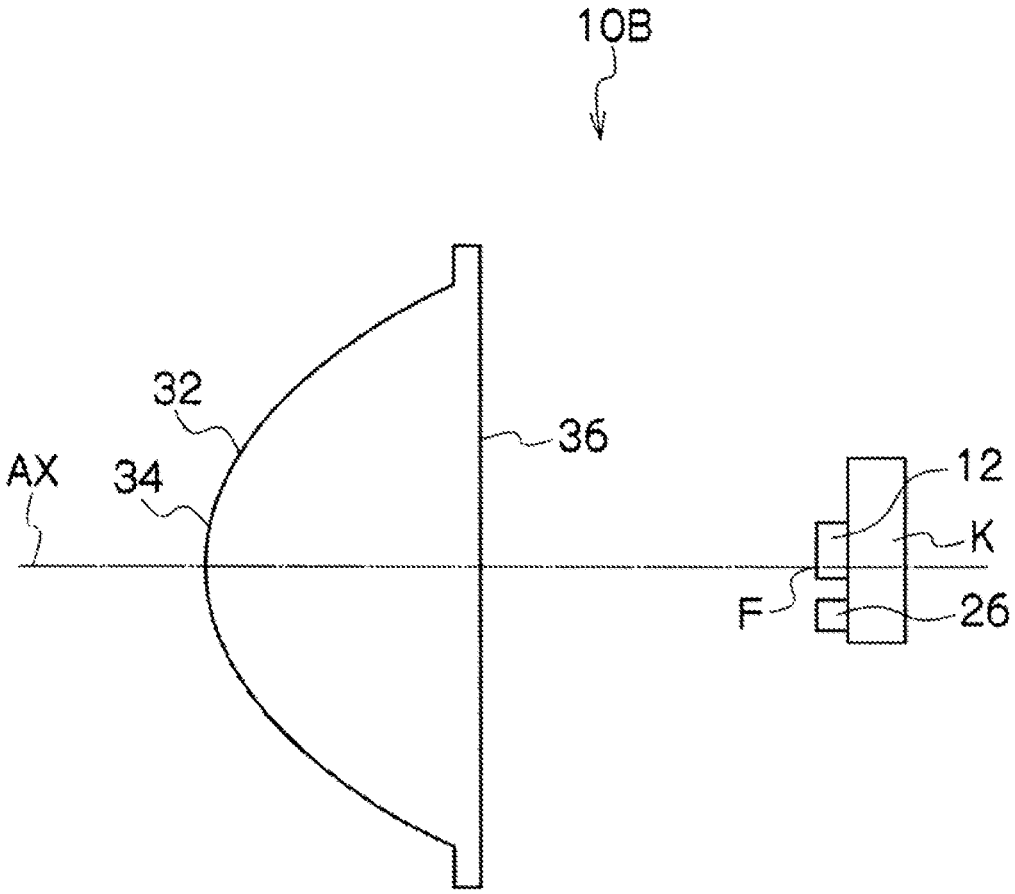
FIG. 9 is a vertical cross-sectional view of a modified example of a vehicle lighting unit according to the presently disclosed subject matter vertically cut along a plane including its center axis.

FIG. 9 is a vertical cross-sectional view of the modified example illustrating a vehicle lighting unit 10B vertically cut along a plane including its center axis.

As shown in FIG. 9, the vehicle lighting unit 10B is different from the vehicle lighting unit 10 of the previous exemplary embodiment(s) in that a projector lens 32 is used in place of the light guide lens 14, and other configuration and members thereof can be the same as or similar to those of the vehicle lighting unit 10 of the previous exemplary embodiment(s). Hereinafter, the difference will be described, and the same or similar components to those of the vehicle lighting unit 10 of the previous exemplary embodiment(s) will be denoted by the same reference numerals, and the description thereof will be omitted.

The projector lens 32 can be a common projector lens having at least a front surface 34 to be disposed on a front side of a vehicle body and a rear surface 36 to be disposed on a rear side of the vehicle body.

The projector lens 32 can have a focal point F on the rear side, and the semiconductor light emitting elements 12 (12*a* to 12*e*) can be located substantially at (i.e., at or near) the focal point F.

The rear surface 36 of the projector lens 32 can serve as a light incident surface on which the light emitted from the semiconductor light emitting elements 12 (12*a* to 12*e*) can impinge. The front surface 34 of the projector lens 32 can serve as a light exiting surface from which the light having entered the lens can exit.

The front surface 34 and/or the rear surface 36 can be designed in surface shape so that the light exiting forward through the front surface 34 (or the light source image of the semiconductor light emitting elements 12) can form the low beam light distribution pattern P as shown in FIG. 5.

In order to form the over-head sign light distribution pattern $P_{OHS}$, a reflection surface 26 for forming an over-head sign light distribution pattern is disposed below the semiconductor light emitting elements 12 (12*a* to 12*e*).

In some cases in the present modified example, part of light emitted from the semiconductor light emitting elements 12 (12*a* to 12*e*) also may not enter the projector lens 32, but can be reflected downward by the rear surface 36 to the position below the semiconductor light emitting elements 12 (12*a* to 12*e*).

The light reflected by the rear surface 36 can be reflected by the reflection surface 26 for forming an over-head sign light distribution pattern. Then, the reflected light can enter the projector lens 32 through the rear surface 36, and be refracted by the front surface 34, thereby being projected forward.

Since the reflection surface 26 for forming an over-head sign light distribution pattern is located below the semiconductor light emitting elements 12 (12*a* to 12*e*) as in the previous exemplary embodiment(s), the light projected from the front surface 34 can be directed upward with respect to the horizontal plane. This can form the over-head sign light distribution pattern $P_{OHS}$.

As described above, the light emitted from the semiconductor light emitting elements 12 (12*a* to 12*e*) that is reflected by the rear surface 36 and which does not enter the projector lens 32 can be reflected by the reflection surface 26 for forming an over-head sign light distribution pattern. The reflected light can then enter the projector lens 32 through the rear surface 32, and exit through the front surface 34 to be projected forward. Since the reflection surface 26 for forming an over-head sign light distribution pattern can be disposed below the semiconductor light emitting elements 12 (12*a* to 12*e*), the light projected through the front surface 34 can be directed upward by a predetermined angle with respect to the horizontal plane. Accordingly, the over-head sign light distribution pattern $P_{OHS}$ can be formed by that light.

As described, by effectively utilizing the part of light emitted from the semiconductor light emitting elements 12 (12*a* to 12*e*) that does not enter the projector lens 32 due to the reflection by the rear surface 36 to form the over-head sign light distribution pattern $P_{OHS}$, the resulting vehicle lighting unit 10B can be provided with higher light utilization efficiency.

The vehicle lighting unit can be used as an automotive headlamp, an auxiliary lamp, a rear lamp, and the like.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A vehicle lighting unit comprising:

a lens having a focal point, a first surface configured to be disposed towards a front side of a vehicle body and a second surface configured to be disposed towards a rear side of the vehicle body;

a semiconductor light emitting element disposed substantially at the focal point of the lens; and a substrate on which the semiconductor light emitting element is mounted, wherein part of the second surface faces to the semiconductor light emitting element and is configured to serve as a light incident area that allows light emitted from the semiconductor light emitting element to enter the lens and also configured to reflect a portion of the light emitted from the semiconductor light emitting element, the first surface is configured to allow light entering the lens through the second surface to exit the lens, at least one of the first surface and the second surface is designed in surface shape so that light exiting forward through the first surface forms a low beam light distribution pattern, and the vehicle lighting unit further includes a reflection surface mounted on the substrate and configured to reflect the portion of the light reflected by the light incident area to form an overhead sign light distribution pattern after the portion of the light has passed through the second and first surfaces, the reflection surface disposed below the semiconductor light emitting element.

2. A vehicle lighting unit comprising:

a light guide lens having a reference point, a first surface configured to be disposed towards a front side of a vehicle body, a second surface configured to be disposed towards a rear side of the vehicle body and a recessed portion including a third surface;

a semiconductor light emitting element disposed within the recessed portion and substantially at the reference point of the light guide lens; and a substrate on which the semiconductor light emitting element is mounted, wherein the second surface includes a reflection area extending from the recessed portion in a predetermined direction, the third surface surrounds the semiconductor light emitting element, so that light emitted from the semiconductor light emitting element is incident on the third surface and part of the third surface is configured to reflect a portion of the light emitted from the semiconductor light emitting element, the first surface is configured to reflect light which has entered the light guide lens through the third surface toward the reflection area of the second surface while also configured to allow the light reflected by the reflection area of the second surface to exit the lens therethrough, at least one of the first surface, the second surface and the third surface is designed in surface shape so that light exiting forward through the first surface forms a low beam light distribution pattern, and the vehicle lighting unit further includes a reflection surface mounted on the substrate and configured to reflect the portion of the light reflected by the light incident area to form an overhead sign light distribution pattern after the portion of the light has passed through the third and first surfaces, the reflection surface disposed below the semiconductor light emitting element.

3. The vehicle lighting unit according to claim 1, wherein the reflection surface configured to form an over-head sign light distribution pattern is formed from at least one of a mirror and a high reflectance member.

4. The vehicle lighting unit according to claim 2, wherein the reflection surface configured to form an over-head sign light distribution pattern is formed from at least one of a mirror and a high reflectance member.

5. A vehicle lighting unit comprising:

a lens having a focal point, a first surface configured to be disposed towards a front side of a vehicle body and a second surface configured to be disposed towards a rear side of the vehicle body; and a semiconductor light emitting element disposed substantially at the focal point of the lens, wherein the second surface is configured to allow light emitted from the semiconductor light emitting element to enter the lens, the first surface is configured to allow light entering the lens through the second surface to exit the lens, at least one of the first surface and the second surface is designed in surface shape so that light exiting forward through the first surface forms a low beam light distribution pattern, and the vehicle lighting unit further includes, a reflection surface configured to form an overhead sign light distribution pattern, the reflection surface disposed below the semiconductor light emitting element, a high reflectance member surrounding the semiconductor light emitting element so as to extract light emitted from the semiconductor light emitting element by reflection, and a shading member disposed to cover the high reflectance member while exposing part of the high reflectance member that functions as the reflection surface for forming an over-head sign light distribution pattern.

6. A vehicle lighting unit comprising:

a light guide lens having a reference point, a first surface configured to be disposed towards a front side of a vehicle body, a second surface configured to be disposed towards a rear side of the vehicle body and a recessed portion including a third surface; and a semiconductor light emitting element disposed within the recessed portion and substantially at the reference point of the light guide lens, wherein the second surface includes a reflection area extending from the recessed portion in a predetermined direction, the third surface surrounds the semiconductor light emitting element, so that light emitted from the semiconductor light emitting element is incident on the third surface, the first surface is configured to reflect light which has entered the light guide lens through the third surface toward the reflection area of the second surface while also configured to allow light reflected by the reflection area of the second surface to exit the lens therethrough, at least one of the first surface, the second surface and the third surface is designed in surface shape so that light exiting forward through the first surface forms a low beam light distribution pattern, and the vehicle lighting unit further includes, a reflection surface configured to form an overhead sign light distribution pattern disposed below the semiconductor light emitting element, a high reflectance member surrounding the semiconductor light emitting element so as to extract light emitted from the semiconductor light emitting element by reflection, and a shading member disposed to cover the high reflectance member while exposing part of the high reflectance member that functions as the reflection surface for forming an over-head sign light distribution pattern.

7. The vehicle lighting unit according to claim 3, wherein the high reflectance member is formed from a white resin.

8. The vehicle lighting unit according to claim 4, wherein the high reflectance member is formed from a white resin.

9. The vehicle lighting unit according to claim 5, wherein the high reflectance member is formed from a white resin.

10. The vehicle lighting unit according to claim 6, wherein the high reflectance member is formed from a white resin.

11. The vehicle lighting unit according to claim 1, wherein the vehicle lighting unit is an automotive headlamp.

12. The vehicle lighting unit according to claim 2, wherein the vehicle lighting unit is an automotive headlamp.

13. The vehicle lighting unit according to claim 3, wherein the vehicle lighting unit is an automotive headlamp.

14. The vehicle lighting unit according to claim 4, wherein the vehicle lighting unit is an automotive headlamp.

15. The vehicle lighting unit according to claim 5, wherein the vehicle lighting unit is an automotive headlamp.

16. The vehicle lighting unit according to claim 6, wherein the vehicle lighting unit is an automotive headlamp.

17. The vehicle lighting unit according to claim 1, further wherein the light emitting element and the reflection surface configured to form an over-head sign light distribution pattern are separated from the lens.

18. The vehicle lighting unit according to claim 2, wherein the light emitting element and the reflection surface configured to form an over-head sign light distribution pattern are separated from the guide lens.

* * * * *